US010260333B2

(12) United States Patent
Peters et al.

(10) Patent No.: US 10,260,333 B2
(45) Date of Patent: Apr. 16, 2019

(54) SYSTEM AND A METHOD FOR DETERMINING INFLOW DISTRIBUTION IN AN OPENHOLE COMPLETED WELL

(71) Applicant: Total E&P Danmark A/S, Copenhagen (DK)

(72) Inventors: Robert Bouke Peters, Aberdeen (GB); Kenneth Brough, Copenhagen (DK)

(73) Assignee: Total E&P Danmark A/S, Copenhagen (DK)

( * ) Notice: Subject to any disclaimer, the term of this patent is extended or adjusted under 35 U.S.C. 154(b) by 11 days.

(21) Appl. No.: 15/022,462

(22) PCT Filed: Sep. 17, 2014

(86) PCT No.: PCT/EP2014/069754
§ 371 (c)(1),
(2) Date: Mar. 16, 2016

(87) PCT Pub. No.: WO2015/040041
PCT Pub. Date: Mar. 26, 2015

(65) Prior Publication Data

US 2016/0222779 A1 Aug. 4, 2016

(30) Foreign Application Priority Data

Sep. 17, 2013 (DK) ..... 2013 70515

(51) Int. Cl.
*E21B 27/00* (2006.01)
*E21B 47/10* (2012.01)
(Continued)

(52) U.S. Cl.
CPC ..... *E21B 47/1015* (2013.01); *E21B 27/00* (2013.01); *E21B 27/02* (2013.01); *E21B 43/11* (2013.01)

(58) Field of Classification Search
CPC ..... E21B 47/1015; E21B 27/00; E21B 27/02; E21B 43/11
See application file for complete search history.

(56) References Cited

U.S. PATENT DOCUMENTS 3,493,757 A 2/1970 Glenn
2001/0036667 A1 11/2001 Tayebi et al.
(Continued)

FOREIGN PATENT DOCUMENTS

CN 2156283 Y 2/1994
CN 1898455 A 1/2007
(Continued)

OTHER PUBLICATIONS

Search Report for Danish Application No. PA 2013 70515, Completed May 2, 2014.
(Continued)

*Primary Examiner* — D. Andrews
*Assistant Examiner* — Yanick A Akaragwe
(74) *Attorney, Agent, or Firm* — Brinks Gilson & Lione

(57) ABSTRACT

The invention relates to a system and a method for determining flow patterns of fluid in a production well. Especially, the invention relates to a method of determining flow patterns between and into oil production wells drilled in the Earth when flow is improved by water flooding. The system comprises a canister (1) said canister being located in said formation at a subterranean location within or proximate the wellbore, the canister being provided with an exit opening (5), a traceable component (4) being placed in the canister and able to pass through the exit opening and a release mechanism capable of releasing the traceable component when triggered by a triggering mechanism such that the traceable component enters the fluid flowing through the well through the exit opening and is present in the fluid flow
(Continued)

Figure 1:
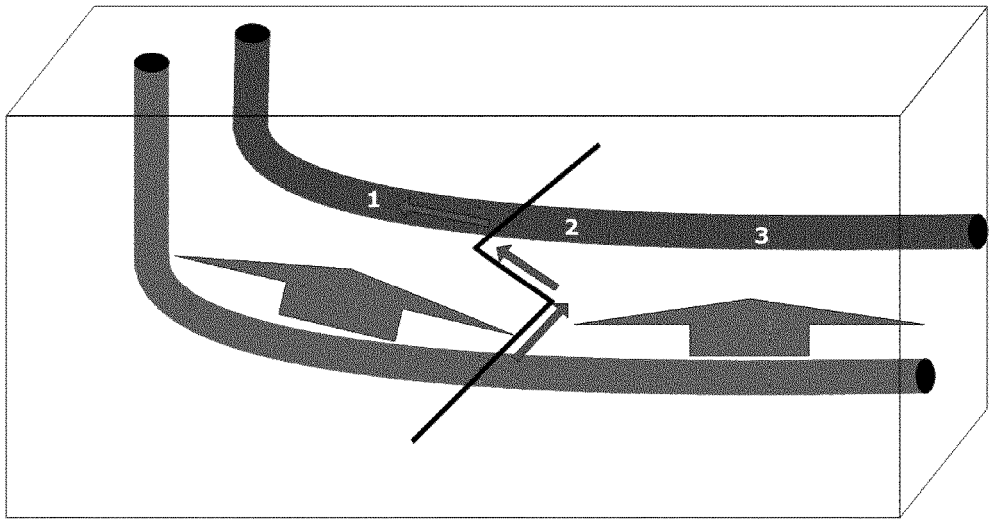

in the wellbore. The method comprising the steps of providing a canister in said formation at a subterranean location within or proximate the wellbore said canister holding a traceable component and being provided with an exit opening and monitoring the fluid flow from the wellbore at a location remote from said canister for the presence of traceable component.

20 Claims, 2 Drawing Sheets

(51) Int. Cl.
*E21B 27/02* (2006.01)
*E21B 43/11* (2006.01)

(56) References Cited

U.S. PATENT DOCUMENTS

| | | | |
|---|---|---|---|
| 2003/0056952 | A1 | 3/2003 | Stegemeier et al. |
| 2009/0087911 | A1 | 4/2009 | Ramos |
| 2009/0087912 | A1 | 4/2009 | Ramos et al. |
| 2009/0151939 | A1 | 6/2009 | Bailey et al. |
| 2009/0301778 | A1 | 12/2009 | Taylor |
| 2010/0108148 | A1 | 5/2010 | Chen et al. |
| 2010/0193184 | A1 | 8/2010 | Dolman et al. |
| 2011/0257887 | A1 | 10/2011 | Cooper et al. |
| 2011/0277544 | A1 | 11/2011 | Rytlewski et al. |
| 2011/0297371 | A1 | 12/2011 | Church et al. |
| 2013/0091943 | A1* | 4/2013 | Skillingstad ..... E21B 47/09 73/152.54 |
| 2013/0257617 | A1* | 10/2013 | Alicot ..... G08B 13/2482 340/572.1 |

FOREIGN PATENT DOCUMENTS

| | | | |
|---|---|---|---|
| CN | 102041995 | A | 5/2011 |
| EP | 2372331 | A1 | 10/2011 |
| GB | 2443327 | B | 5/2009 |
| NO | 20120319 | A | 9/2013 |
| WO | 200181914 | A1 | 11/2001 |
| WO | 2007102023 | A1 | 9/2007 |
| WO | 2008024448 | A1 | 2/2008 |
| WO | 2011112391 | A1 | 9/2011 |
| WO | 2011132040 | A2 | 10/2011 |
| WO | 2013009895 | A1 | 1/2013 |

OTHER PUBLICATIONS

International-Type Search Report for DK 2013 70515, Completed May 26, 2014.
International Search Report and Written Opinion for PCT/EP2014/069754, dated Jun. 10, 2015.
Preliminary Report on Patentability for PCT/EP2014/069754, dated Mar. 22, 2016.

* cited by examiner

SYSTEM AND A METHOD FOR DETERMINING INFLOW DISTRIBUTION IN AN OPENHOLE COMPLETED WELL

RELATED APPLICATIONS

This application claims the benefit under 35 U.S.C. § 371 of the filing date of International Patent Application No. PCT/EP2014/069754, having an international filing date of Sep. 17, 2014, which claims priority to Danish Application No. PA 2013 70515, filed Sep. 17, 2013, the contents of all of which are incorporated herein by reference in their entirety.

TECHNICAL FIELD

The invention relates to a system and a method for determining flow patterns of fluid in a production well. Especially, the invention relates to a method of determining flow patterns between and into oil production wells drilled in the Earth when flow is improved by water flooding.

BACKGROUND

Wells are drilled into the Earth to allow recovery of hydrocarbons such as paraffins, napthenes, aromatics and asphaltics or gases such as methane. These wells may be vertical, deviated e.g. at an angle or horizontal depending on the size, location and nature of the reservoir into which they are drilled.

Once drilled, a series of liners and tubings may be installed such elements are sometimes known as completion. The gap between the wellbore and the completion is called the annulus. This can be filled with cement to prevent axial flow along the length of the well but can also be penetrated to allow fluid flow in some desired areas.

Open hole completions have no cement in the annulus but may still contain a tubular liner. This may have been installed where it was considered that the wellbore could collapse, but if that danger is not present then the well may be completed without any liner fitted. Such wells without completions are referred to as "barefoot".

To aid recovery of hydrocarbon from the reservoir, a technique known as water flooding may be used. Additional wells are drilled and water is pumped into them under pressure. The water displaces oil from the formation and helps to maintain reservoir pressure. When injecting water in long horizontal wells, a method called linedrive can be used, whereby horizontal producer wells and water injector wells are drilled in alternating order.

The objective of the linedrive method is to inject water evenly from the entire length of the injection well. This should cause an even displacement of oil into the production wells so maximising the amount that is recovered from the reservoir. However, natural fractures or other conductive features are sometimes present in the formation which can cause water to travel preferentially or "short-circuit" from the water injector to the producer well. This results in a suboptimal displacement of the oil and reduces the total amount recovered from the formation. Within the industry, this is referred to as non-conformance and is illustrated in FIG. 1. The narrow arrows show the undesired short circuit route for water compared to the preferred water flooding effect which is shown with wide arrows placed along the water injection well with direction toward the production well.

In order to treat this type of non-conformance a first step is to determine where water enters the horizontal section of an oil production well unevenly. This may be achieved by a number of current methods such as production logging tools (PLT) which may be conveyed on coiled tubing, electric wireline or on jointed tubing. Wireline or possibly coiled tubing also requires a tractor to pull the PLT into the horizontal well. Use of a tractor introduces an additional problem in barefoot wells since existing tractors are not able to grip the formation or propel the tractor with sufficient force to overcome increasing friction of the wireline or tubing. Also, tractors may not have the required expansion ratio to be able to operate in uneven open holes. Having been deployed through small diameter upper tubing they may not be physically able to grip a wide hole.

Where deployment is considered possible, heavy equipment is also required which can often cause logistical problems at the well location, especially when operating offshore. It is also very costly. With very long horizontal wells it may also be impossible for these tools to reach the end of the well so the objective of this type of deployment will not be met. It is therefore advantageous to have a method to detect the water inflow into an oil production well without the need to use e.g. electric or memory logging tools.

Such an alternative is offered by the use of chemical tracers. Chemical tracers can be placed at various intervals on a completion in a producer well (positions 1, 2 and 3 in FIG. 1) and are dissolved into oil and/or water. The oil/water-flow then carries the tracer to the surface, where the tracer is detected. The presence of chemicals from known positions in the well can help determine which parts of the well are being affected by water and whether oil is flowing from all sections.

Tracer technologies are currently available in several forms.

US 2009/0087912 discloses a tagging system and a method comprising release of particles having a miniature body and configured to provide a non-radioactive resolvable optical emission in a distinguishable pattern when illuminated to a subsurface location. US 2009/0087912 comprises chambers (50, 52) containing particles (10), the compartments are carried by a downhole tool and are not stationary relative to the subterranean formation.

US 2001/036667 discloses a method for monitoring and detection according to which method the reservoir is divided into a number of zones/sections and specific tracers with unique characteristics for each zone/section are placed as integrated parts of the well completion. The tracers are chemically immobilized or integrated into the formation or in/on the constructions/filters around the wells. The tracers or tracer carriers are chemically intelligent and released as a function of specific events [0019]. It is suggested that a number of tracers (5) can be packed or immobilized into a small package (12), e.g. a chemically intelligent gel or a polymer package (11). It is not suggested in US 2001/036667 that the tracers can be held in or released from a canister.

WO2013/009895 discloses a method and system for reservoir interrogation where a tracer is encapsulated in a receptacle. The encapsulation is constituted by thin spherical shells normally made of a polymer which can turn permeable under certain conditions and release the chemical tracer held inside. It is not suggested in WO2013/009895 that the tracers can be held in or released from a canister.

US2011/0257887 discloses a method for monitoring a wellbore by providing a tracer material at one or more subterranean locations within or proximate the wellbore where the tracer may enter the flow and be present in the flow from the wellbore. The tracer may be supplied within a container being part of an apparatus placed in the wellbore at completion and released into the flow by operating that apparatus [0033]. There are no details in relation to the container and it is not suggested that a canister is driven into the wellbore. According to [0074] the tracer can be placed in a container (50) mounted on the exterior of the production tubing (14).

WO 2001/81914 discloses a method comprising dividing regions around wells in the reservoir into a number of sections, and injecting or placing specific tracers with unique characteristics for each section into the formation in these regions. The tracers are chemically immobilized/integrated in the formation or in constructions/filters around the wells, the tracers (tracer carriers) being chemically intelligent and released as a function of specific events. Detecting the tracers downstream provides information about the various zones.

WO 2007/102023 describes a similar concept with novel materials being used. It also describes a method of applying tracer material to a well via detonation. The proposal is that tracer material is introduced into the path of explosive energy from a perforation tool, which is known equipment within the industry. Detonation of the perforation charge shall then scatter the tracer in the well. This method applies the tracers as residue from an explosive detonation. A disadvantage is that there is uncertainty over the amount of tracer that will be applied to the wall of the wellbore. Detonation may also not completely transfer the tracer in its path.

Regardless of how chemical tracers may be applied to the wellbore, the current state of technology is that fluid samples must be collected from the wellhead and analysed at a remote laboratory. There is no immediate method of determining the presence of known tracer elements in fluids from the well. However, WO 2011/132040 describes the concept of detecting chemical tracers at the well head rather than by remote analysis.

The present specification discloses a novel method according to which different traceable components are attached at various positions along a barefoot well. The traceable components shall be installed and held in a dispenser such as a carrier or canister which dispenser shall be attached in the walls of the production well at desired intervals. The traceable components is then released gradually over time and carried to the surface by fluids from the production well.

SUMMARY OF INVENTION

The invention relates to a system for determining flow patterns of a target fluid into an openhole completed well having a wellbore extending through a subterranean formation, the system comprising:

- a canister said canister being located and attached to the walls of the completed well in said formation at a subterranean location within or proximate the wellbore, the canister being provided with an exit opening;
- a traceable component being placed inside the canister and able to pass through the exit opening;
- a release mechanism placed inside the canister and capable of releasing the traceable component when triggered by a triggering mechanism such that the traceable component enters the fluid flowing through the well through the exit opening and is present in the fluid flow through the wellbore. The trigger mechanism can be either a pre-programmed time signal or a received signal or a signal provided by a sensor detecting the target fluid. The release mechanism is placed inside the canister i.e. within outer walls of the canister or in close proximity to the canister in such a way that the release mechanism can be said to be part of the canister.

The exit opening is facing the fluid flow in the wellbore. The canister should not extend into the wellbore with a length of more than 5% of the diameter of the wellbore, preferably with a length of maximum 1% of the diameter of the wellbore in order to allow passage for tools through the wellbore.

The system normally also includes a reader or monitor positioned remote from the at least one canister and is capable of detecting the passage of the traceable component at a given location downstream of the canister e.g. at the well head or at the Christmas tree.

The Wellhead is the component at the surface of an oil or gas well that provides the structural and pressure-containing interface for the drilling and production equipment. The primary purpose of a wellhead is to provide the suspension point and pressure seals for the casing strings that run from the bottom of the hole sections to the surface pressure control equipment. Once the well has been drilled, it is completed to provide an interface with the reservoir rock and a tubular conduit for the well fluids. The surface pressure control is provided by a Christmas tree being installed on top of the wellhead, with isolation valves and choke equipment to control the flow of well fluids during production.

Normally an injection unit is introduced into the wellbore and used to insert the canister into the completed walls of the wellbore.

According to one embodiment the release mechanism comprises an expandable material, said expandable material being placed such that the material forces the traceable component out of the canister when expanding and the triggering mechanism is the contact between a target fluid and the expandable material. The expandable material is normally positioned between a wall of the canister and the traceable components. The traceable components are placed closest to the exit opening, can be moved relative to the canister, and are pushed toward the exit opening by the expanding material. The expandable material can comprise or be constituted by a polymer.

According to second embodiment the release mechanism comprises a motor which motor when activated forces the traceable component out of the canister. The release mechanism of this embodiment is triggered by either a pre-programmed set time or a received signal or the trigger mechanism is a sensor detecting the target fluid and sending a signal to the motor. The "received signal" can e.g. be transmitted from a remote sender operated by personnel i.e. a signal is only send upon request, or e.g. from a remote sender transmitting automatic signals at certain intervals.

Regardless of which embodiment is used, the target fluid might be water, a hydrocarbon, a mixture of hydrocarbons or a gas such as $CO_2$.

The canister of the system might comprise a magazine part containing at least two independent discrete traceable components.

The traceable component of the system can be a RFID tag or be an amount of pulverized material. If the traceable component is an amount of pulverized material, a discrete portion of material might be released upon triggering the release mechanism.

The invention also relates to a method for determining flow patterns of a target fluid into an openhole completed well having a wellbore extending through a subterranean formation, the method comprising the steps of:

providing a canister in said formation at a subterranean location within or proximate the wellbore said canister holding a traceable component and being provided with an exit opening;

monitoring the fluid flow from the wellbore at a location remote from said canister for the presence of traceable component.

Normally, the monitoring will take place at the surface i.e. at the wellhead or at the Christmas tree but the monitoring units could also be installed inside the production well i.e. anywhere in the wellbore downstream of at least one of the canisters of the system.

The invention also relates to a method for installing a canister in an openhole completed well having a wellbore extending through a subterranean formation, said canister being installed in said formation at a subterranean location within or proximate the wellbore, comprising an exit opening, and containing a traceable component able to pass through the exit opening said canister further comprising a release mechanism capable of releasing the traceable component when triggered by a triggering mechanism, wherein the canister is driven into the wellbore by means of detonation of an explosive charge.

The invention allows monitoring in wells where conventional intervention does not have the reach needed to get to the end of the well. Normally, the invention will be utilising the drilling assembly, or at least an assembly run before the drilling mud is removed, to place and/or install the tracer canisters.

The traceable component could be of the same types as mentioned for the system e.g. the traceable component could be a RFID tag and the fluid flow from the wellbore is monitored by a detector such as a radio transmitter-receiver. Alternative methods for installing the canister could be to release an elastically deformed pre-sprung metal collar defining the canister and containing traceable components such that the collar will be forced against the wellbore wall after release.

Alternative methods for installing the canister could be to drill a small hole into the wellbore, insert the canister in the drilled hole and e.g. us a suitable adhesive to keep the canister in the correct position.

The particularities listed for the system also relates to the mentioned methods.

Generally, a system according to the invention comprises at least one canister or dispenser holding one or more, normally a plurality, of traceable components, the canister or dispenser comprises a housing providing a hard shell which protects the inner parts, the housing comprises an exit opening through which one or more traceable components can leave the canister when triggered. The end of the canister being provided with the exit opening is pointing into the fluid flow in the well when the canister is in its operational position in the wellbore. The housing of the opposite end of the canister i.e. the end of the canister facing away from the fluid flow in the wellbore is normally embedded in the formation and can have a pointing shape e.g. cone-shaped in order to facilitate positioning of the canister in the wall of the wellbore.

The canister might also be provided with secondary openings through which water or hydrocarbons can get in contact with sensitive parts or material carried in the canister. The secondary openings might be covered with a material which is permeable for either water or hydrocarbons.

According to the invention, the canister also comprises a release mechanism and may additionally comprise or be associated with a trigger mechanism, where the release mechanism is capable of releasing a traceable component when triggered by said triggering mechanism. When the release mechanism is triggered a single traceable component or a plurality of traceable components or a discrete amount of traceable component may be expelled from the canister entering into the fluid flow in the wellbore thereby making it possible to detect the traceable component downstream in the well, normally at the wellhead.

The release means normally comprises driving means capable of forcing one or more traceable components out of the exit opening. The driving means comprise an energy source which energy source normally is stored chemical energy which can be converted into electrical energy or develop heat or expansion.

The triggering mechanism can be activated either once or several times. By way of example, the trigger mechanism can be activated due to contact with a component such as water or oil or gas, providing mapping of a given event, or the trigger mechanism can be activated at predetermined time intervals, i.e. triggering is a function of time, providing continues mapping of the flow in the well. Alternatively, the trigger mechanism can be first activated at a given time and then afterwards be activated by contact to a component such as water, oil or gas.

The traceable components may be chemical i.e. the traceable components is detectable by its presence in a certain concentration or the traceable components emit energy due to a change of state which energy can be detected such as light, radioactivity or other radiation. Chemical traceable components as such are known and available, and can be used in a system according to the present invention when installed into a canister.

The traceable components may be electronic i.e. the traceable components may emit a signal originating from an electromagnetic field, the traceable component can be either an active or a passive component. Electronic traceable components such as Radio Frequency Identification (RFID) tags or other passive devices are known as such and can be used in a system according to the present invention when installed into a canister.

When a dispenser or canister is attached to the formation the traceable components may be released over time and carried to the surface in the fluid flowing in the well. The traceable components should be immediately detectable at the surface by an appropriate technology depending on the nature of the traceable component.

Anchoring of the canister to the sidewall of the well is required to ensure that no obstruction is created in the well, allowing future free passage of fluids and logging tools or other interventions. Examples of methods which can be used to anchor the traceable component carriers are:

Launching a dispenser/canister containing the traceable components into the sidewall of the wellbore by means of detonation of a small explosive charge (propellant actuated device).

Releasing an elastically deformed pre-sprung metal collar containing traceable components such that the collar will be forced against the wall of the well after release.

Drilling a small hole into the wall of the well and inserting the dispenser/canister which may be held in place by suitable adhesive.

The canisters containing traceable components can be injected or positioned at a subterranean location to the correct anchored positions by an injection unit in the walls of the well by several different methods.

One method is to modify prior art developed and fielded by several oilfield service companies such as Baker Hughes and Schlumberger. These companies provide tools to take core samples from the sidewalls of wellbores. Such tools could be easily modified to also allow insertion of canisters containing traceable components once a core sample has been removed. The canister might be held in position by an adhesive added to the drilled opening.

A second method of deployment may involve utilizing existing perforation guns. Perforation guns are currently inserted into wells and fire small explosive charges through the completion in order to allow well fluid to flow into it. Modification of such standard perforation guns is required as it is necessary to incorporate a magazine of propellant actuated canisters which are fired into the wellbore, i.e. the sidewalls of the well, at a desired position. Propellant actuated canisters may also be transported to the required position by tractor if reachable.

The system and methods of the present application is directed to positioning and use specific dispensers or canisters in a barefoot well at the end of the drilling operation and before the well is produced.

LIST OF FIGURES

Explanatory and exemplary embodiments according to the invention are illustrated in the figures:

FIG. 1 illustrates water flooding between a water injection well and a production well.

Figure 2:
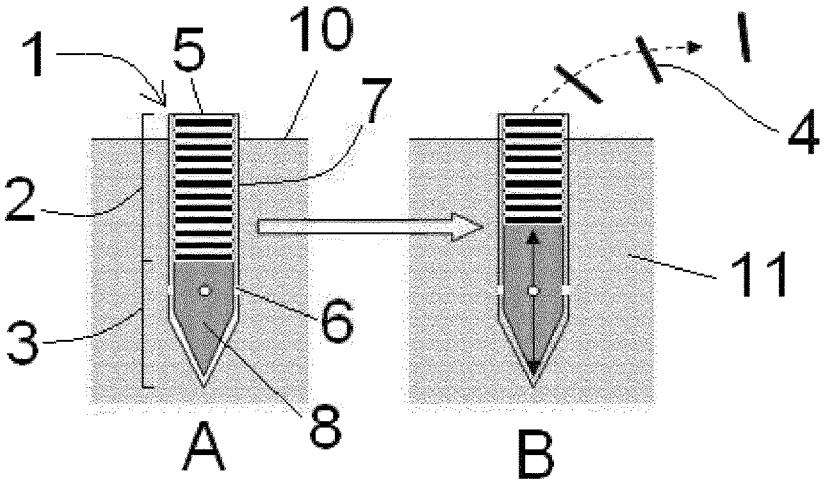

FIG. 2 discloses a first embodiment of a dispenser holding ID tags.

Figure 3:
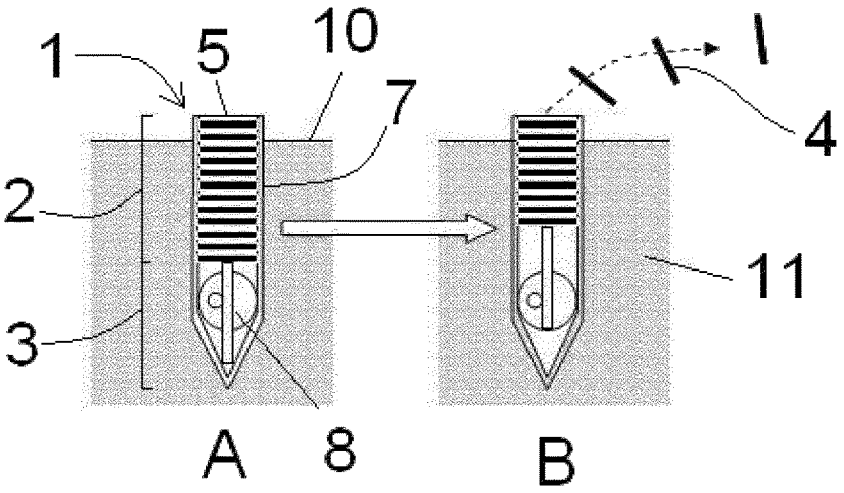

FIG. 3 discloses a second embodiment of a dispenser holding ID tags.

DETAILED DESCRIPTION

FIG. 2 discloses a first embodiment of a canister 1 holding traceable components 4. The illustrated canister 1 is placed in the wall of a wellbore having one end facing the flow of the well and the opposite end embedded in the wall. The illustrated canister 1 comprises a housing 7 and internally in this housing are two sections, a first section 2 holding the traceable components 4 and a second section 3 holding driving means 8. In the shown embodiment the two sections are positioned in extension of each other, however the sections could be placed differently in relation to each other depending on both what kind of traceable components are used and what kind of driving means are used. Normally the first section 2 is reduced in volume during operation whereas the volume of the second section 3 is increased in volume during operation.

The first section 2 is placed at the end of the canister 1 facing the fluid flow in the well; this end of the housing of the canister 1 comprises an exit opening 5 through which the traceable components can pass when leaving the canister 1 and entering into the fluid flow of the well. The housing 7 providing the outer walls for this end of the canister 1 of the shown embodiment is cylindrical. The traceable components 4 shown in FIG. 2 are RFID tags.

The second section 3 is according to the shown embodiment placed at the end of the canister facing away from the fluid flow in the well i.e. the end which during use is embedded in the wall. The housing 7 providing an outer wall for this end of the canister 1 of the shown embodiment is partly cylindrical and partly cone-shaped and the walls of this part of the housing are provided with secondary openings 6. The secondary openings 6 allow the fluid to enter or get in contact with the driving means 8 of the canister. In the embodiment shown in FIG. 2 the driving means 8 are constituted by a polymer which expands when it gets into contact with water.

In FIG. 2A the canister 1 has been positioned in the sidewall of a wellbore. In the illustrated embodiment around 7% of the length of the canister protrudes relative to the surface 10 of the sidewall. Generally, a canister according to the invention should not extend into the wellbore with a length of more than 5% of the diameter of the wellbore, preferably with a length of maximum 1% of the diameter of the wellbore in order to allow passage for tools through the wellbore. The polymer 8 has not yet been in contact with water and is therefore at its original volume and all the traceable components 4 are still held in the first section 2 of the canister. In FIG. 2B the polymer 8 has been in contact with water and has started to swell/expand and three of the traceable components have been pushed out of the canister and into the flow of the wellbore.

FIG. 3 discloses a second embodiment of a canister 1 holding traceable components 4. The reference numbers of FIG. 3 refers to the same components as the reference numbers of FIG. 2. Only difference between the first and the second shown embodiments is that another kind of driving means are used with the second embodiment. The driving means 8 of the second embodiment is a micro or linear motor which forces traceable components in form of RFID tags into well. The motor dispenses traceable components into the well as a function of time and does therefore not need any contact with the surrounding fluids, the housing 7 of the second embodiment does therefore not comprise secondary openings. That the dispensing of traceable components is a function of time means that the driving means are either pre-programmed to start and dispense at a given time and e.g. at given intervals or that the driving means starts and dispenses in response to a received signal.

In both FIG. 2 and FIG. 3 the surface 10 illustrates the inner surface of the wellbore along which the fluid of the production well flows, the grey matter 11 illustrates the porous material constituting the walls of the wellbore. The canisters 1 need not be fully buried in the wall but the canisters should be placed in a position deep enough to allow free passage of fluids and equipment in the wellbore. Preferably, a short part of the length of the canister should protrude from the surface 10 of the walls in order to ensure that the traceable components are caught in the flow of the well and not caught by irregularities in the wall. A short part of the length of the canister would be considered to be between 5-10% of the total length of the canister. Normally, it would be preferred to place the exit opening for the traceable components as close to the wellbore as possible i.e. at the same level as the wall. If the exit opening of the canister is placed a distance beneath the surface this would increase the risk of traceable components being caught by irregularities of the surrounding wails.

According to both the first and the second embodiment disclosed in FIGS. 2 and 3, the canister contains a plurality of discrete traceable components. If the traceable components were of a chemical type the canister would contain an amount of traceable component and release a discrete amount of traceable component upon activation.

The combination of application of RFID technology with well-known deployment methods is very advantageous, especially as this method can be applied in a barefoot well. This opens up their use to a previously excluded category of wells.

The invention might also relate to a system for determining flow patterns of a target fluid into an openhole completed well having a wellbore extending through a subterranean formation, the system comprising:

a canister said canister being located in said formation at a subterranean location within or proximate the wellbore, the canister being provided with an exit opening;

a traceable component being placed in the canister and able to pass through the exit opening;

a release mechanism capable of releasing the traceable component when triggered by a triggering mechanism such that the traceable component enters the fluid flowing through the well through the exit opening and is present in the fluid flow in the wellbore.

The release mechanism of the above system might comprises an expandable material, said expandable material being placed such that the material forces the traceable component out of the canister when expanding and the triggering mechanism is the contact between a target fluid and the expandable material. According to such a system said expandable material might comprise or is constituted by a polymer and/or said target fluid is water, a hydrocarbon, a mixture of hydrocarbons or a gas.

Alternatively, the release mechanism of the above system might comprise a motor which motor when activated forces the traceable component out of the canister. According to this embodiment, the trigger mechanism might either a pre-programmed time signal or a received signal or by a signal from a sensor detecting the target fluid.

According to any embodiment of the above system, the canister can comprise a magazine part containing at least two independent discrete traceable components.

According to any embodiment of the above system, said traceable component is a RFID tag.

According to any embodiment of the above system, said traceable component is an amount of pulverized material.

According to another aspect the invention relates to a method for determining flow patterns of a target fluid into an openhole completed well having a wellbore extending through a subterranean formation, the method comprising the steps of:

providing a canister in said formation at a subterranean location within or proximate the wellbore said canister holding a traceable component and being provided with an exit opening;

monitoring the fluid flow from the wellbore at a location remote from said canister for the presence of traceable component.

According to yet another aspect the invention relates to a method for installing a canister in an openhole completed well having a wellbore extending through a subterranean formation, said canister being installed in said formation at a subterranean location within or proximate the wellbore, comprising an exit opening, and containing a traceable component able to pass through the exit opening said canister further comprising a release mechanism capable of releasing the traceable component when triggered by a triggering mechanism, wherein the canister is driven into the wellbore by means of detonation of an explosive charge. According to any embodiment of the above methods, the traceable component(s) is (are) a RFID tag and the fluid flow from the wellbore is monitored by a detector such as a radio transmitter-receiver.

The invention claimed is:

1. A system for determining flow patterns of a target fluid into an open hole completed well having an open-hole wellbore extending through a subterranean formation, the system comprising:

a canister, said canister being embedded in the wall of the open-hole wellbore in said formation at a subterranean location within the open-hole wellbore, the canister being provided with an exit opening;

a traceable component being placed inside the canister and able to pass through the exit opening;

a release mechanism and a triggering mechanism placed inside the canister, the release mechanism being configured to release the traceable component when triggered by the triggering mechanism such that the traceable component enters the fluid flowing through the well through the exit opening and is present in the fluid flow in the open-hole wellbore, the triggering mechanism activates according to either a pre-programmed time signal or in response to a signal.

2. The system according to claim 1 wherein the release mechanism comprises a motor which motor when activated forces the traceable component out of the canister.

3. The system according to claim 2 wherein the canister comprises a magazine part containing at least two independent discrete traceable components.

4. The system according to claim 2 wherein said traceable component is an RFID tag.

5. The system according to claim 2 wherein said traceable component is an amount of pulverized material.

6. The system according to claim 1, wherein the canister comprises a magazine part containing at least two independent discrete traceable components.

7. The system according to claim 1, wherein said traceable component is an RFID tag.

8. The system according to claim 1, wherein said traceable component is an amount of pulverized material.

9. A system for determining flow patterns of a target fluid into an open hole completed well having an open-hole wellbore extending through a subterranean formation, the system comprising:

a canister, said canister being embedded in a wall of the open-hole wellbore in said formation at a subterranean location within the open-hole wellbore, the canister being provided with an exit opening in a first section of the canister;

a traceable component being placed inside the canister and able to pass through the exit opening in the first section:

an expandable material disposed in the canister and adjacent to the traceable component in a second section of the canister, said expandable material being placed such that the material forces/urges the traceable component out of the canister when the expandable material comes into contact with a target fluid.

10. The system according to claim 9 wherein said expandable material comprises or is constituted by a polymer.

11. The system according to claim 10, wherein said target fluid is water, a hydrocarbon, a mixture of hydrocarbons or a gas.

12. The system according to claim 10 wherein the canister comprises a magazine part containing at least two independent discrete traceable components.

13. The system according to claim 9, wherein said target fluid is water, a hydrocarbon, a mixture of hydrocarbons or a gas.

14. The system according to claim 9 wherein the canister comprises a magazine part containing at least two independent discrete traceable components.

15. The system according to claim 9 wherein said traceable component is an RFID tag.

16. The system according to claim 9 wherein said traceable component is an amount of pulverized material.

17. A method for determining flow patterns of a target fluid into an open hole completed well having an open-hole wellbore extending through a subterranean formation, the method comprising the steps of:

providing a canister, said canister holding a traceable component and being provided with an exit opening, a release mechanism placed inside the canister configured to release the traceable component when triggered by a triggering mechanism such that the traceable component enters the fluid flowing through the well through the exit opening and is present in the fluid flow in the open-hole wellbore, the triggering mechanism activates according to either a pre-programmed time signal or in response to a received signal, embedding the canister in a wall of said open-hole wellbore of said formation at a subterranean location within the open-hole wellbore, triggering said release mechanism;

monitoring the fluid flow from the open-hole wellbore at a location remote from said canister for the presence of traceable component.

18. The method according to claim 17, wherein the traceable component(s) is(are) an RFID tag and the fluid flow from the wellbore is monitored by a detector such as a radio transmitter-receiver.

19. A method for installing a canister in an openhole completed well having a wellbore extending through a subterranean formation, said canister being installed in said formation at a subterranean location within or proximate the wellbore, comprising an exit opening, and containing a traceable component able to pass through the exit opening, said canister further comprising a release mechanism configured to release the traceable component when triggered by a triggering mechanism, wherein the canister is driven into a wall of the wellbore by means of detonation of an explosive charge, to embed said canister in said wall of the open-hole wellbore.

20. The method according to claim 19, wherein the traceable component(s) is(are) an RFID tag and the fluid flow from the wellbore is monitored by a detector such as a radio transmitter-receiver.

* * * * *